United States Patent [19]

Pizzolato

[11] Patent Number: 4,717,069

[45] Date of Patent: Jan. 5, 1988

[54] HOT FOOD CARTON HAVING INSULATED BOTTOM WALL STRUCTURE

[76] Inventor: Donald E. Pizzolato, 125 Fleming St., Piscataway, N.J. 08854

[21] Appl. No.: 57,485

[22] Filed: Jun. 3, 1987

[51] Int. Cl.[4] ..... B65D 5/70; A45C 11/20

[52] U.S. Cl. ..... 229/104; 229/902; 206/545; 220/3.1

[58] Field of Search ..... 229/104, 120, 902, 903, 229/906; 99/DIG. 15; 428/920; 206/545; 220/3.1

[56] References Cited

U.S. PATENT DOCUMENTS

| | | | |
|---|---|---|---|
| 1,961,342 | 6/1934 | De Reamer | 65/15 |
| 2,001,632 | 5/1935 | Schlichting | 154/45 |
| 3,861,576 | 1/1975 | Tolaas et al. | 229/3.5 R |
| 4,096,948 | 6/1978 | Kuchenbecker | 229/104 |
| 4,260,060 | 4/1981 | Faller | 229/104 |
| 4,344,534 | 8/1982 | Sutton | 206/545 |
| 4,360,107 | 11/1982 | Roccaforte | 206/626 |
| 4,360,118 | 11/1982 | Stern | 206/545 |
| 4,367,243 | 1/1983 | Brummett et al. | 99/DIG. 15 |
| 4,373,636 | 2/1981 | Hoffman | 206/545 |
| 4,441,626 | 4/1984 | Hall | 229/120 |
| 4,476,989 | 10/1984 | Larsen | 206/545 |
| 4,505,391 | 3/1985 | Kuchenbecker | 229/903 |

*Primary Examiner*—Willis Little

*Attorney, Agent, or Firm*—Lerner, David, Littenberg, Krumholz & Mentlik

[57] ABSTRACT

A carton for hot foods in which the bottom wall of the carton comprises a plurality of layers which enclose therebetween a plurality of void spaces that serve to limit the conduction of heat from hot foods positioned on the upper surface of the bottom wall of the carton to a cold surface on which the bottom surface of the bottom wall rests. The void spaces may take the form of a plurality of generally conical dimples depressed into the lower layer of the bottom wall, or may take the form of elongated V-shaped grooves or furrows depressed into the lower layer of the bottom wall.

14 Claims, 7 Drawing Figures

HOT FOOD CARTON HAVING INSULATED BOTTOM WALL STRUCTURE

FIELD OF THE INVENTION

This invention relates to cartons for transporting hot foods such as pizza pies from the vendor's store to the purchaser's home and, more particularly, to such cartons which are insulated to prevent heat loss by conduction during such transportation.

BACKGROUND OF THE INVENTION

Pizza pies are generally delivered to the customer's home or carried home by the customer in a flat rectangular closed carton. The carton is generally made from a laminated cardboard or paperboard including a central inexpensive pulpy material layer and higher quality outer laminated layers, which together form a relatively thin, heat conductive wall.

When a customer purchases a pizza pie, it is generally taken hot from the oven and placed on the upper surface of the bottom wall of the carton or on a sheet of waxed paper or the like that has been placed on the upper surface of the bottom wall. The hot pie is thus in direct heat conduction contact with the bottom wall or the sheet of paper on top of the bottom wall. Thereafter, the customer or the delivery man takes the carton with the hot pie and, in many cases, drives it to the purchaser's home. During that trip, the carton containing the hot pie is frequently laid upon the cold seat or other cold surface in the driver's vehicle and the hot pie tends to be significantly cooled during the delivery process due to a transfer of heat from the bottom of the carton to the seat, resulting in a dissatisfied customer.

It is, therefore, a primary object of the present invention to provide an improved carton for transporting hot foods such as pizza pies.

Another object of the present invention is to provide an improved hot food carton in which insulation is provided on the bottom wall of the carton to keep the hot food enclosed therein hotter for a longer period of time during the transporation thereof to the customer's home.

A further object of the invention is to provide an improved hot food carton wherein the bottom wall of the carton comprises a multi layer insulation structure that includes a plurality of depressions and void spaces therein, which structure insulates the hot food in the carton from cold support surfaces during transport of the carton.

Additional objects and advantages of this invention will become apparent as the following description proceeds.

SUMMARY OF THE INVENTION

Briefly stated and in accordance with one embodiment of this invention an improved hot food carton is provided in which the bottom wall of the carton comprises a plurality of layers which enclose therebetween a plurality of void spaces that serve to limit the conduction of heat from hot food positioned on the upper surface of the bottom wall of the carton to a cold surface on which the bottom surface of the bottom wall rests. The void spaces may take the form of a plurality of generally conical dimples depressed into the lower layer of the bottom wall, or may take the form of elongated V-shaped grooves or furrows depressed into the lower layer of the bottom wall.

BRIEF DESCRIPTION OF THE DRAWINGS

While the specification concludes with claims particularly pointing out and distinctly claiming the subject matter regarded as the invention herein, it is believed that the present invention will be more readily understood from the following description, taken in conjunction with the accompanying drawings, in which:

Referring to FIGS. 1 and 2, an insulated pizza pie carton in accordance with one embodiment of this invention has been illustrated generally at 10. The carton 10 includes a bottom portion 12 and a top portion 14. The bottom portion 12 of the carton includes conventional front, rear and side walls 16 and a conventional bottom wall 18 which forms the upper layer of a multilayer insulated wall structure, indicated generally at 20.

Figure 1:
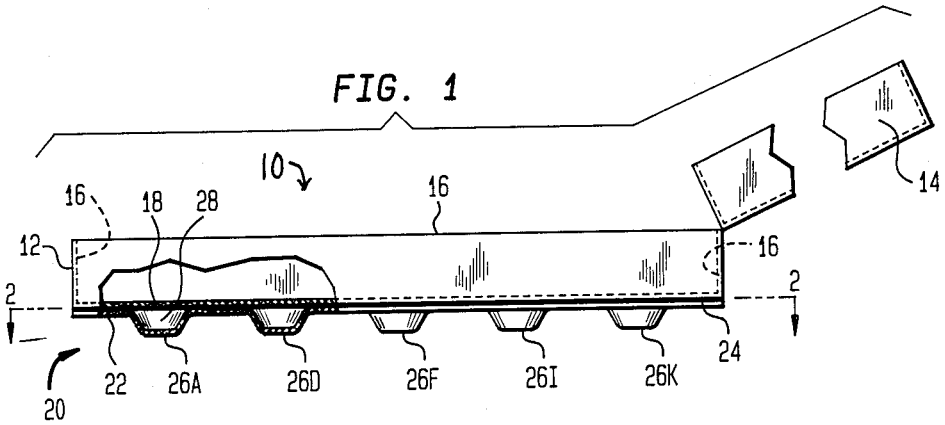
FIG. 1 is a side elevation view of a pizza pie carton made in accordance with one embodiment of this invention.
Figure 2:
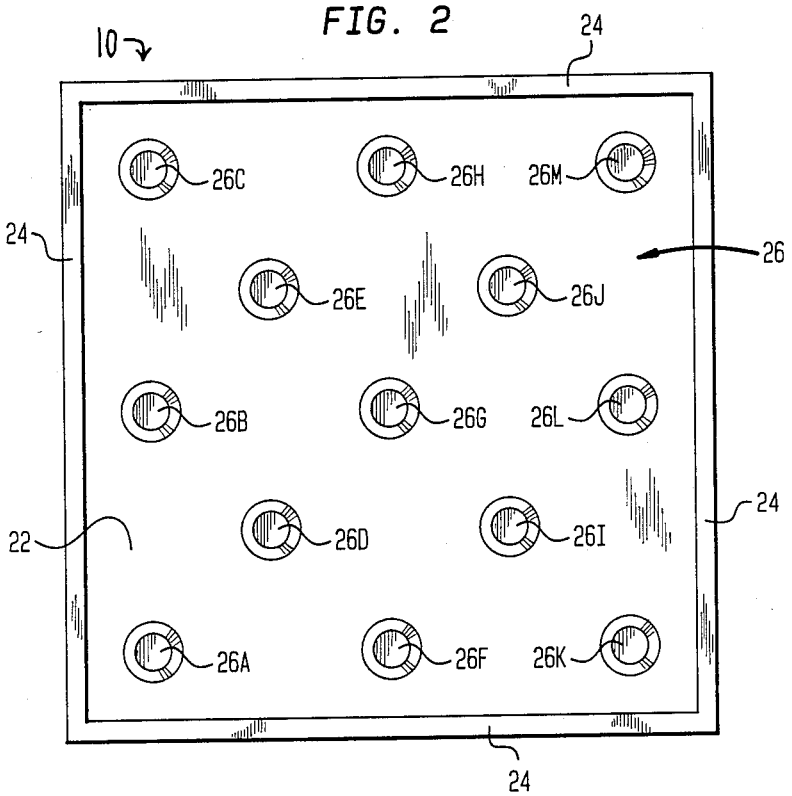
FIG. 2 is a sectional plan view of the carton shown in FIG. 1, taken along the line of 2—2 of FIG.1.

The insulated wall structure 20 includes a generally imperforate lower layer 22 that is adhered to the bottom surface of the conventional bottom wall 18 of the carton by means of an adhesive strip means 24 carried on the upper surface of the lower layer 22, adjacent the periphery thereof.

The lower insulation wall layer 22 is preferably molded from a pulpy cardboard material, similar to that which is employed as egg layer spacers in egg crates, and has formed therein a plurality of generally conical depressions or dimples, shown generally at 26 and individually at 26A–26M. The depressions 26A–26M preferably extend over or encompass a minor portion of the total surface area of the lower layer 22. The depressions 26A–26M could, of course, be generally spherical in shape or could take other shapes so long as they extend downwardly below the plain of the lower surface of the layer 22 so as to form protrusions extending downwardly from such lower surface and so as to create dead air spaces or voids 28 between the upper layer 18 and lower layer 22 of the multi-layer insulated wall structure 20. Alternatively, elongated rib-like depressions or furrows, extending either longitudally or transversely, or forming a lattice-like arrangement, could be employed to form the protrusions on the lower layer 22 and the void spaces between upper layer 18 and lower layer 22.

In an alternative version of the lower layer 22, the adhesively coated perimeter portion of the lower layer could be spaced from, or raised relative to, the major portion of the layer so as to adhere to the bottom wall 18, and the depressions or protrusions 26A–26M could extend upwardly from such major portion into abutment with the bottom wall 18 of the carton. This arrangement would also provide significant dead air space separation of the hot food from a cold support surface and limit heat flow by conduction from the carton to such surface.

In the foregoing embodiments of the invention, currently extant stocks of conventional cartons can easily be converted into improved insulated cartons within the scope of this invention by merely adhering thereto lower layers 22. The layers 22 can be economically fabricated and nested together for shipment and storage by utilizing conventional "peel" strips to cover the adhesive coated perimeter portions thereof during such shipment and storage.

When the lower layer 22 is adhered to a conventional carton, an insulated pizza pie carton in accordance with this invention is formed in which the heat conductivity of the bottom wall of the carton is greatly diminished, helping to insure that the hot pizza pie that is introduced into the carton remains hot until it is delivered to the customer's home.

Figure 3:
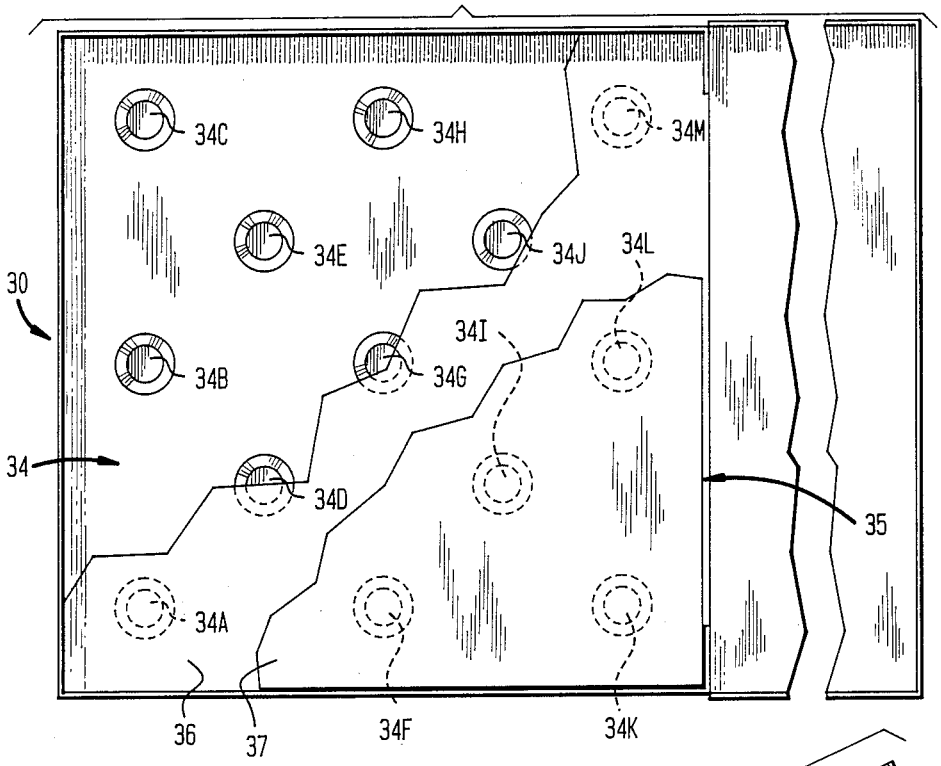
FIG. 3 is a top plan view of a pizza pie carton in accordance with an alternate embodiment of this invention, with portions thereof cut away for clarity.
Figure 4:
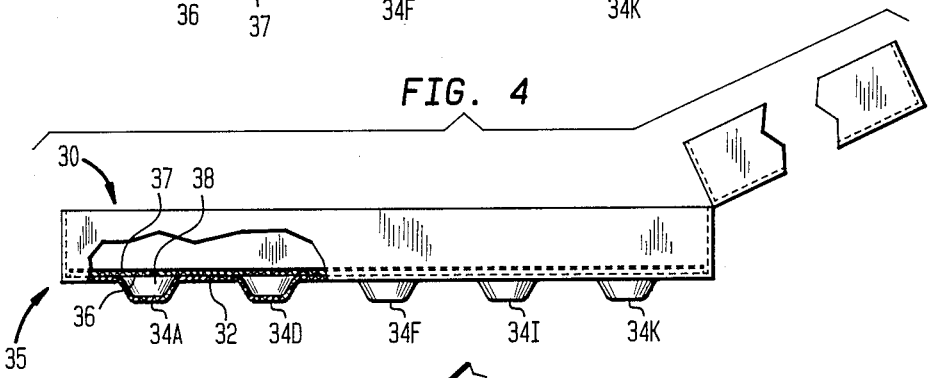
FIG. 4 is a side elevation view of the pizza pie carton of FIG. 3, with portions thereof cut away for clarity.
Figure 5:
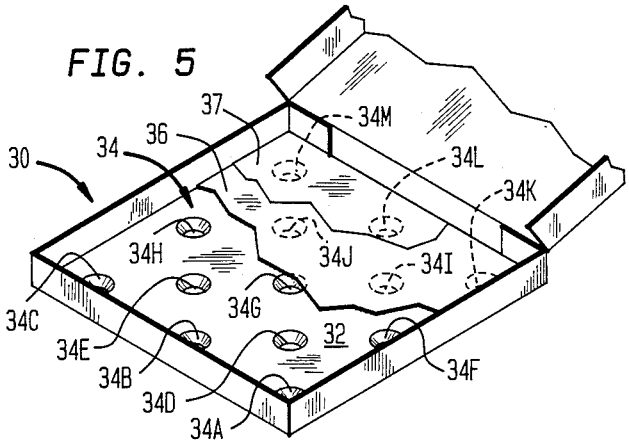
FIG. 5 is a perspective view of the pizza pie carton shown in FIGS. 3 and 4, as seen from a point above the left front portion thereof.

Referring now to FIGS. 3–5, an alternative form of a pizza pie carton made in accordance with this invention has there been illustrated generally at 30. In this embodiment, the bottom wall 32 of the carton has the depressions or dimples, indicated generally at 34 and individually at 34A–34M, formed directly therein. The bottom wall 32 forms the lower layer of the multi-layer insulated wall structure, which structure is shown generally at 35. An upper layer 36, comprised of paperboard or cardboard having a foiled upper surface 37, is positioned atop the bottom wall 32 of the structure 34 so as to form therebetween a plurality of dead air spaces or voids 38. The upper layer 36 is preferably generally flat so that the hot viscous materials of the pizza pie carried in the carton will not tend to flow into depressions or hollows that would otherwise exist in layer 36.

As in the case of the first embodiment, the two layers 32 and 36 of the insulated wall structure 35 may be separately stacked to conserve space, and may be assembled at the vendor's premises when the cartons 30 are erected from the flat blanks in which they are conventionally shipped. The depressions 34 of each carton blank nest conveniently in the depressions of the adjacent carton blanks to facilitate stacking and, in the latter connection, it has been found convenient to have the walls of the depressions form an included angle of about 60°. This serves to provide for adequate void space and also allows the flat carton blanks to be nested tightly together. When assembled, the foiled surface 37 of the upper layer 36 of the insulated wall structure is preferably positioned so as to be facing the pizza pie that is placed into the carton in order to better reflect the heat of the pizza pie back into the carton when the carton is assembled. This enhances the insulating quality of the structure 35.

Figure 6:
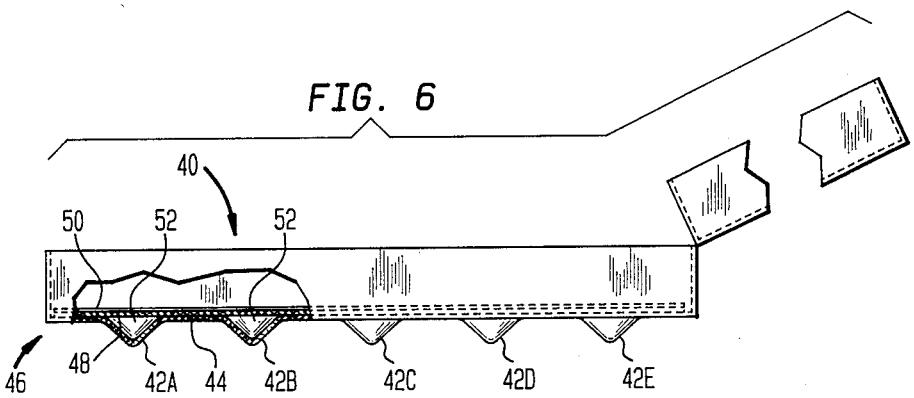
FIG. 6 is a side elevation view, with portions thereof cut away for clarity, of a third embodiment of the pizza pie carton in accordance with a third embodiment of this invention; and, FIG. 7 is a top plan view, with portions thereof cut away for clarity, of the pizza pie carton shown in FIG. 6.
Figure 7:
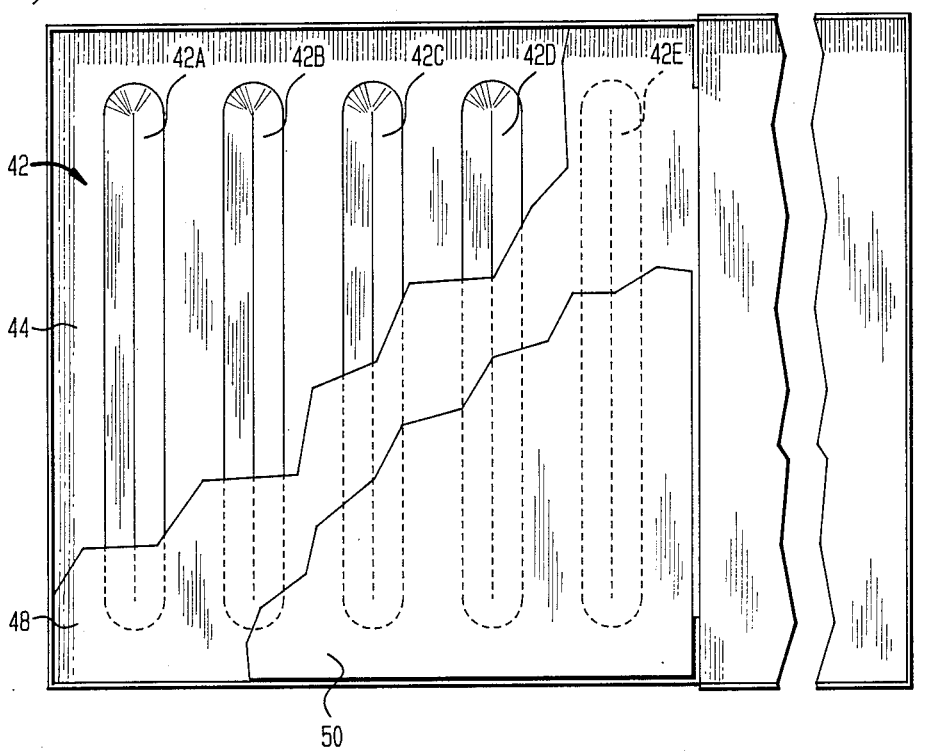

Referring now to FIGS. 6 and 7, a pizza pie carton made in accordance with yet another embodiment of this invention has there been illustrated at 40. In this case the carton 40 is quite similar to the carton 30 shown in the embodiment of FIGS. 3–5; however, in place of the depressions 34A–34M the carton 40 is provided with a series of transversely extending, elongated, V-shaped (in cross section) depressions or furrows indicated generally at 42 and individually at 42A–42E. The depressions 42A–42E are formed in the bottom wall 44 of carton 40, which bottom wall 44 comprises the lower layer of a multi-layer insulated wall structure, shown generally at 46. The multi-layer insulated wall structure 46 includes an upper layer 48 comprised of paperboard or cardboard having a foiled upper surface 50. When the upper layer 50 is positioned above the lower layer 44 of the insulating structure 46, a plurality of void spaces 52 is formed between the upper layer 48 and the lower layer 44 which limit the transfer of heat by conduction through the insulated wall structure 46.

From the foregoing description, it can be seen that the present invention provides an improved hot food carton having an insulated bottom surface therein which inhibits the transfer of heat by conduction and radiation through the bottom wall of the carton when the carton is placed on a cool surface. The downwardly projecting depressions form void air spaces between the upper and lower layers of the insulating wall structure and generally raise the lower portion of the carton from the surface on which it rests, creating additional air spaces between the lower wall of the insulating wall structure and such surface. This further inhibits the transfer of heat from the hot food in the carton to the support surface.

While there have been shown and described what are presently considered to be the preferred embodiments of this invention, it will be obvious to those skilled in the art that various other changes and modifications may be made without departing from the broader aspects of this invention. For example, although the invention has been described in connection with conventional cardboard pizza cartons, it is apparent that the material of the carton and its multi-layered insulated wall structure could be changed from the materials discussed earlier herein to other materials, such as molded heat resistant plastic materials, and still embody the concepts of this invention. It is, therefore, aimed in the dependent claims, to cover all such changes and modifications as fall within the true spirit and scope of this invention.

What is claimed is:

1. In a carton for maintaining a heated food product warm while the carton rests on a cool surface, the carton including a bottom portion having side walls and a bottom wall, and a top portion covering the bottom portion, the improvement wherein said bottom wall comprises a multi-layer insulated wall structure, including a lower layer having a plurality of depressions formed therein and an upper, generally flat, layer closely abutting said lower layer and forming therewith a plurality of void spaces surrounded by said depressions and said upper layer, the depressed portions of said lower layer being adapted to rest on said cool surface and support the remainder of said structure in spaced relation to said cool surface thereby to retard the flow of heat from the interior of said carton to said cool surface.

2. A carton according to claim 1, wherein said depressed portions of said lower layer encompass a minor portion of the total surface area of said lower layer.

3. A carton according to claim 2, wherein said lower layer of said insulated wall structure is adhesively bonded to the bottom surface of the upper layer thereof, and said upper layer of said insulated wall structure is integral with said side walls of said carton.

4. A carton according to claim 2, wherein said lower layer of said insulated wall structure is integral with the side walls of said carton, and said upper layer is separable from and rests upon said lower layer.

5. A carton according to claim 3 wherein said depressions are generally frusto-conical in shape.

6. A carton according to claim 3, wherein paid depressions generally comprise elongated furrows having V-shaped cross-sections.

7. A carton according to claim 4 wherein said depressions are generally frusto-conical in shape.

8. A carton according to claim 4, wherein said depressions generally comprise elongated furrows having V-shaped cross-sections.

9. A carton according to any of claims 1, 2, 7 or 8, wherein said upper layer comprises a laminate the upper portion of which is a foil.

10. A carton according to claim 9, wherein said bottom and top portions of said carton and the lower portion of said laminate are made of cardboard.

11. For use with a conventional cardboard carton for heated food products in order to better enable the products to be maintained warm while the carton rests on a cool surface, a flat, generally rectangular insulation member having upper and lower surfaces thereon and having a plurality of depressions formed in the upper surface thereof, said depressions encompassing a surface area that represents a minor portion of the total surface area of the insulation member, said depressions extending through the plane of said insulation member so as to form protrusions on the lower surface thereof; adhesive strip means carried on the upper surface of said insulation member generally adjacent to the periphery of said member, and a peel away member covering said adhesive strip means to prevent adhesion of said insulation members to one another when they are stacked together for shipment.

12. An insulation member according to claim 11, wherein said depressions are generally frusto-conical in shape.

13. An insulation member according to claim 11, wherein said depressions generally comprise elongated furrows having V-shaped cross-sections.

14. An insulation member according to any of claims 11–13, wherein said insulation member is made of cardboard.

* * * * *